US009071013B2

(12) United States Patent
Gray

(10) Patent No.: US 9,071,013 B2
(45) Date of Patent: Jun. 30, 2015

(54) ELECTRICAL PLUG AND MATING PAIR OF ELECTRICAL CONNECTORS HAVING A LOCATION SLOT FOR ENGAGEMENT

(71) Applicant: Fusion Components Limited, Twickenham, Middlesex (GB)

(72) Inventor: Ian Gray, Middlesex (GB)

(73) Assignee: Fusion Components Limited, Twickenham (GB)

( * ) Notice: Subject to any disclaimer, the term of this patent is extended or adjusted under 35 U.S.C. 154(b) by 0 days.

(21) Appl. No.: 14/221,768

(22) Filed: Mar. 21, 2014

(65) Prior Publication Data

US 2014/0287607 A1 Sep. 25, 2014

(30) Foreign Application Priority Data

Mar. 21, 2013 (GB) ..... 1305160.2

(51) Int. Cl.

| | |
|---|---|
| ***H01R 13/213*** | (2006.01) |
| ***H01R 13/62*** | (2006.01) |
| ***H01R 13/625*** | (2006.01) |
| *H01R 103/00* | (2006.01) |
| *H01R 9/05* | (2006.01) |

(52) U.S. Cl.

CPC ..... *H01R 13/625* (2013.01); *Y10T 29/49208* (2015.01); *H01R 2103/00* (2013.01); *H01R 9/05* (2013.01)

(58) Field of Classification Search

CPC ..... H01R 13/625; H01R 43/20; H01R 9/05; H01R 2103/00; Y10T 29/49208

USPC ..... 439/314; 29/876

See application file for complete search history.

(56) References Cited

U.S. PATENT DOCUMENTS

| | | | | |
|---|---|---|---|---|
| 5,131,862 | A | 7/1992 | Gershfeld | |
| 7,338,305 | B2 | 3/2008 | Norwood et al. | |
| 2009/0280685 | A1 * | 11/2009 | Gray | 439/607.41 |

OTHER PUBLICATIONS

Combined Search and Examination Report dated Sep. 23, 2013 in United Kingdom Patent Application No. GB1305160.2.

Letter from GB Intellectual Property Office in related application GB 1305160.2 indicating that examiner in that case has no further objections to pending claims, Jul. 22, 2014.

* cited by examiner

*Primary Examiner* — Javaid Nasri

(74) *Attorney, Agent, or Firm* — Byrne Poh LLP

(57) ABSTRACT

An electrical plug comprising: a connector body having a first and second axial end, the first axial end electrically connectable in use to a jack; a ferrule extending from the second axial end of the connector body, to which a cable is electrically and/or physically connectable in use; and an elongate sleeve rotatably mounted on the connector body and having a first and second axial end, wherein the first axial end of the sleeve has at least one bayonet slot for engagement, in use, with a respective lug of a jack, and the second axial end of the sleeve terminates at the second axial end of the connector body, such that the sleeve substantially encloses the connector body.

30 Claims, 4 Drawing Sheets

ELECTRICAL PLUG AND MATING PAIR OF ELECTRICAL CONNECTORS HAVING A LOCATION SLOT FOR ENGAGEMENT

CROSS REFERENCE TO RELATED APPLICATION

This application claims the benefit under 35 U.S.C. §119 of United Kingdom Patent Application No. GB1305160.2, filed Mar. 21, 2013, which is hereby incorporated by reference herein in its entirety.

TECHNICAL FIELD

The present invention relates to an electrical connector, more specifically an electrical plug. The invention also relates to a method of manufacturing a plug.

BACKGROUND

Electrical connectors are used in a variety of fields. The present invention particularly relates to radio frequency (RF) connectors, although the features of the invention are equally applicable to other connectors. A conventional BNC-type RF connector comprises a plug which mates with a corresponding jack. More recently, smaller versions of the conventional BNC connector have been developed. The mechanical features and function of these are ultimately the same as the conventional BNC connector.

U.S. Pat. No. 7,338,305 discloses a known BNC connector, which is illustrated in FIG. 1.

The jack 1 comprises a cylindrical housing 2 defining a central electrical socket 3 having an electrical contact. A pair of lugs 4 extend radially from the cylindrical housing 2, spaced 180 degrees apart. Conventionally, the jack 1 is mounted to a surface (not shown), such as a PCB.

The plug 5 comprises a cylindrical body 6 having a central pin contact within the body 6 (not shown). A ferrule 7 extends from the body, to which a cable is connected in use. When securing a cable to the plug 5, a length of the outer plastic sheath of the cable is first removed, which exposes a woven shield layer beneath. A smaller length of the shield layer is then removed to expose the dielectric insulator core. Finally, a smaller length of the insulator core is then removed to expose the core conductor of the cable. The conductor is inserted into the body 6 of the plug 5 which makes an electrical connection with the contact of the plug 5. The shield layer is typically then electrically secured to the outer surface of the ferrule 7. Finally, a metal cover is then crimped around the end of the cable, to protect the connection and prevent damage. Additionally, a plastic cover may be heat-shrunk around the end of the cable.

The plug 5 further comprises a rotatable sleeve 8 at the axial end which connects to the jack 1, remote from the ferrule 7. The sleeve comprises two bayonet 'J-shaped' slots 9. A resilient element between the body 6 and the sleeve 8 urges the sleeve 8 in an axial direction relative to the body 6, as described below.

To connect the plug 5 to the jack 1, a user grips the sleeve 8 of the plug 5 with the ends of their thumb and index finger and aligns an entry portion 10 of each bayonet slot 9 of the plug 5 with the respective lugs 4 of the jack 1. The user then pushes the plug 5 towards the jack 1 such that the pin contact of the plug 5 is received in the socket 3 of the jack 1, to form an electrical connection with the electrical contact in the socket 3. At the same time, each lug 4 is received in the entry portion 10 of the respective bayonet slot 9. Still gripping the sleeve 8, the user then pushes the sleeve 8 further towards the jack 1, overcoming the bias of the resilient element, thus allowing the sleeve 8 to translate with respect to the body 6. Maintaining this force and continuing to grip the sleeve 8, the user then rotates the sleeve 8 relative to the jack 1. The lug 4 thus translates through the bayonet slot 9. When the lugs 4 contact the end of the bayonet slot 9, the user then releases the axial force. The bias of the resilient element serves to urge the lugs 4 against a terminal portion 11 of the bayonet slot 9, ensuring a positive connection and avoiding inadvertent release of the plug 5 from the jack 1.

Similarly, when removing the plug 5 from the jack 1, the user grips the sleeve 8, applies a force towards the jack 1, against the bias force, then rotates the sleeve 8 and removes the plug 5 from the jack 1.

The method of connection and removal described above is conventional.

It is common to arrange a plurality of jacks 1 across a surface, in close proximity to one another, typically in a grid pattern. When connecting a plurality of plugs 5 to the jacks 1, the plugs 5 will likewise be in close proximity to one another. Once a plurality of plugs 5 are attached to the jacks 1, the removal of a single plug 5, particularly in the centre of the grid array, requires a user to be able to achieve purchase on the sleeve 8 of that plug 5. Given the proximity to other plugs 5, achieving adequate purchase to subsequently rotate the sleeve 8 can be difficult. Similar problems are encountered when securing a plug 5 to a jack 1 in close proximity to other plugs 5.

The problems with removal and installation of plugs are even more acute with smaller BNC plugs and jacks.

SUMMARY

The present invention seeks to provide an improved plug.

Accordingly, the present invention provides an electrical plug comprising: a connector body having a first and second axial end, the first axial end electrically connectable in use to a jack; a ferrule extending from the second axial end of the connector body, to which a cable is electrically and/or physically connectable in use; and an elongate sleeve rotatably mounted on the connector body and having a first and second axial end, wherein the first axial end of the sleeve has at least one bayonet slot for engagement, in use, with a respective lug of a jack, and the second axial end of the sleeve terminates at the second axial end of the connector body, such that the sleeve substantially encloses the connector body.

Preferably, the axial length of the sleeve is equal to or longer than the axial length of the connector body.

Advantageously, the axial length of the sleeve is greater than 10 mm.

Conveniently, the axial length of the sleeve is around 15 mm.

Preferably, at least part of the external surface of the sleeve is knurled.

Advantageously, the knurled section is proximate the second axial end of sleeve. Conveniently, the knurled section is distal from the first axial end of the sleeve. Preferably the knurled section is at least 10 mm from the first axial end of the sleeve.

Advantageously, the axial length of the sleeve is 20 mm. Conveniently, the external diameter of the sleeve is 7 mm.

Preferably, the second axial end of sleeve is provided with at least one location slot for engagement, in use, with an insertion/extraction tool.

Advantageously, the location slot is randomly located on the circumference of the second axial end of the sleeve.

Conveniently, the electrical plug further comprises a crimping sleeve having a first and second axial end and to physically and/or electrically connect a cable to the ferrule.

Preferably, the electrical plug comprises a cable physically and/or electrically connected to the ferrule with the crimping sleeve, wherein the first axial end of the crimping sleeve is adjacent the second axial end of the sleeve and the cable extends from the second axial end of the crimping sleeve.

Advantageously, the distance from the second axial end of the sleeve to the second axial end of the crimping sleeve is less than 20 mm.

The present invention further provides a mating pair of electrical connectors, comprising: an electrical plug according to invention; and a jack having a jack body with at least one lug radially extending from the jack body.

The present invention further provides a method of manufacture of an electrical plug configured for engagement with a jack, the method comprising: providing a connector body having a first and second axial end, the first axial end electrically connectable in use to the jack connector; providing a ferrule extending from the second axial end of the connector body, to which a cable is electrically and/or physically connectable in use; and rotatably mounting a sleeve on the connector body, the sleeve having a first and second axial end, wherein the first axial end of the sleeve has at least one bayonet slot for engagement, in use, with a respective lug of a jack, and the second axial end of the sleeve terminates at the second axial end of the connector body, such that the sleeve substantially encloses the connector body.

Preferably, the method further comprises providing a location slot at a random circumferential position on the second axial end of the sleeve.

BRIEF DESCRIPTION OF DRAWINGS

Embodiments of the present invention will now be described with reference to the accompanying figures in which.

DESCRIPTION OF EMBODIMENTS

Figure 2:
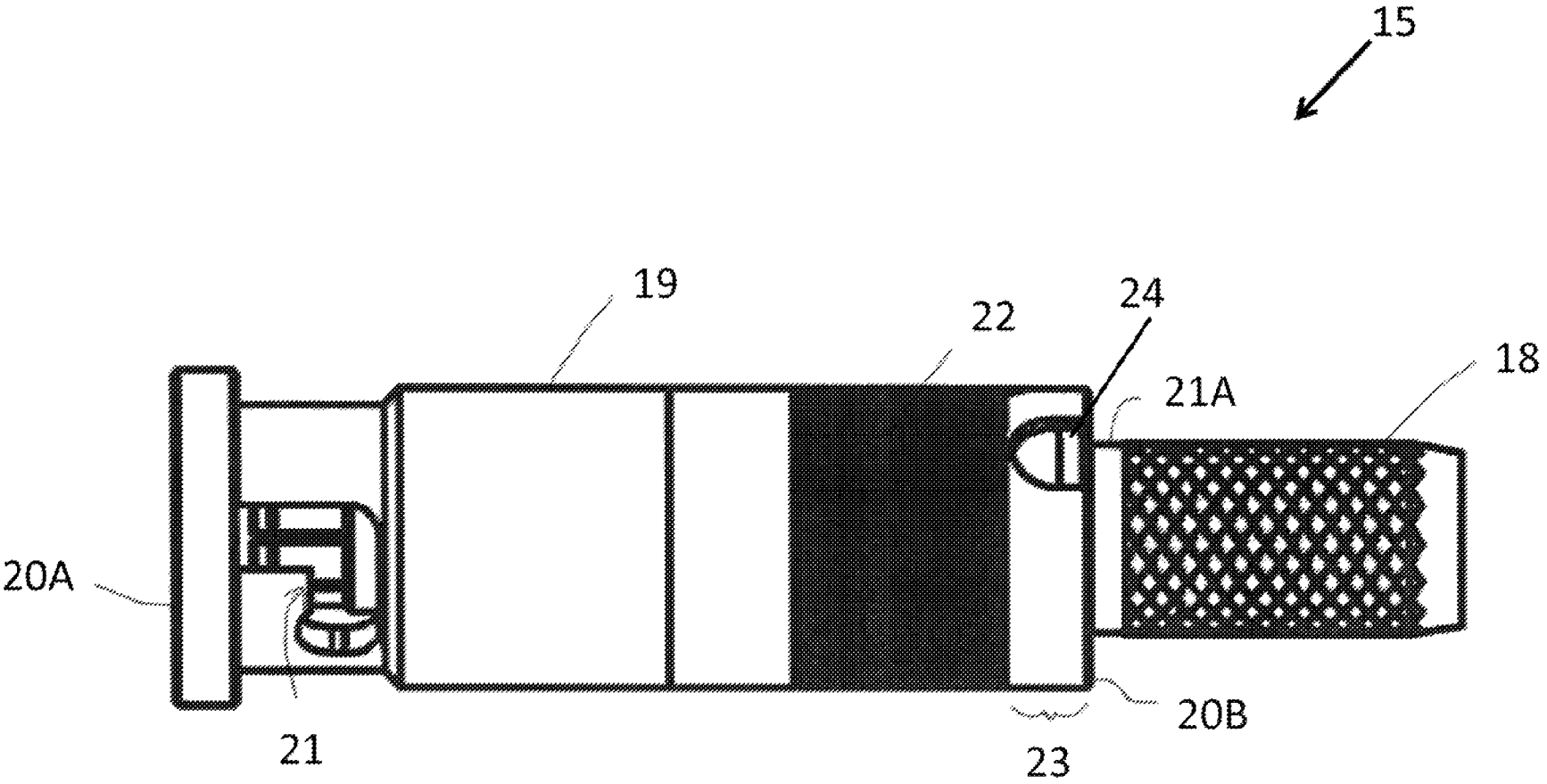
FIG. 2 illustrates a plug according to an embodiment of the present invention.
Figure 3:
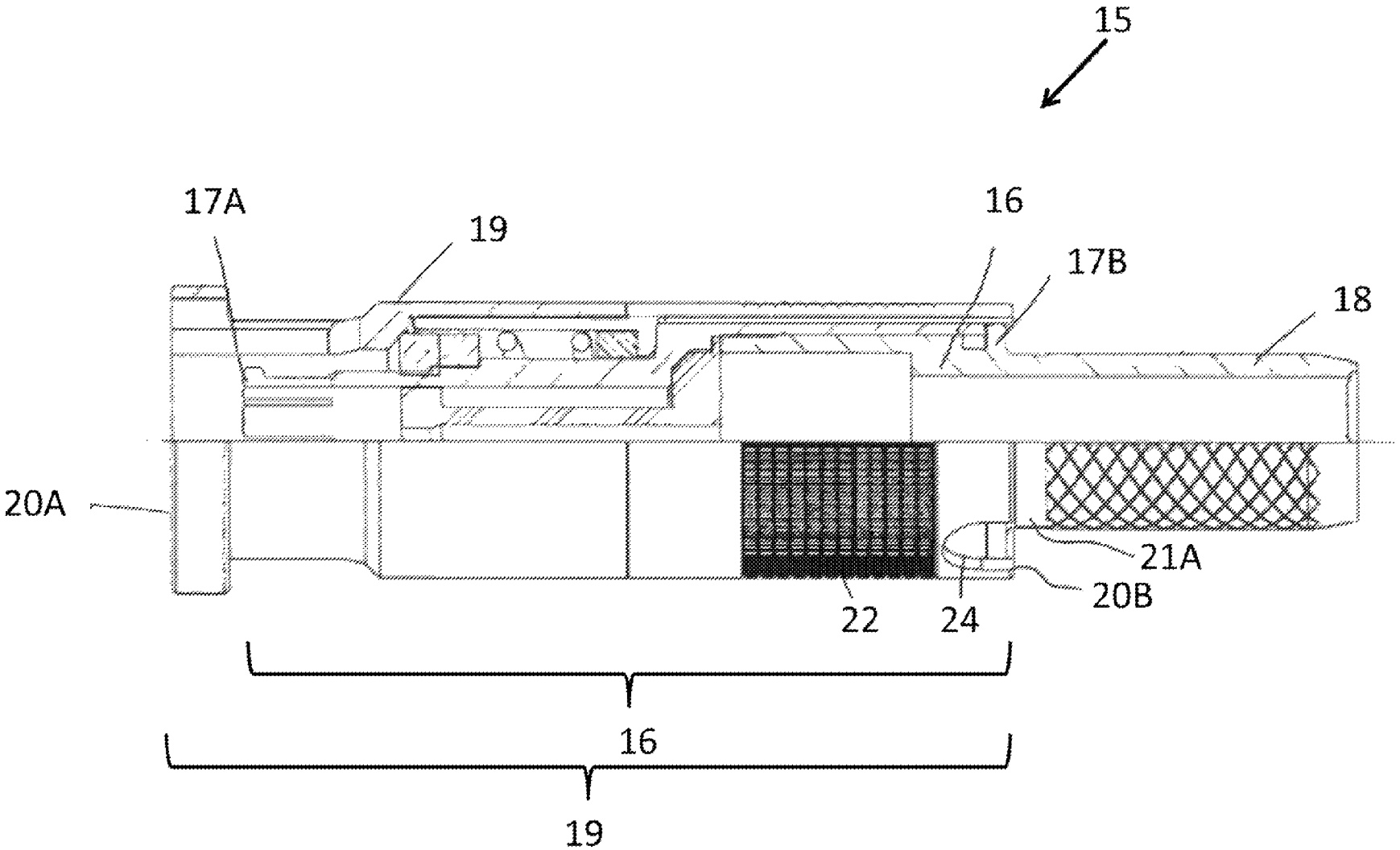
FIG. 3 illustrates a partial cross section of the plug of FIG. 2.
Figure 4:
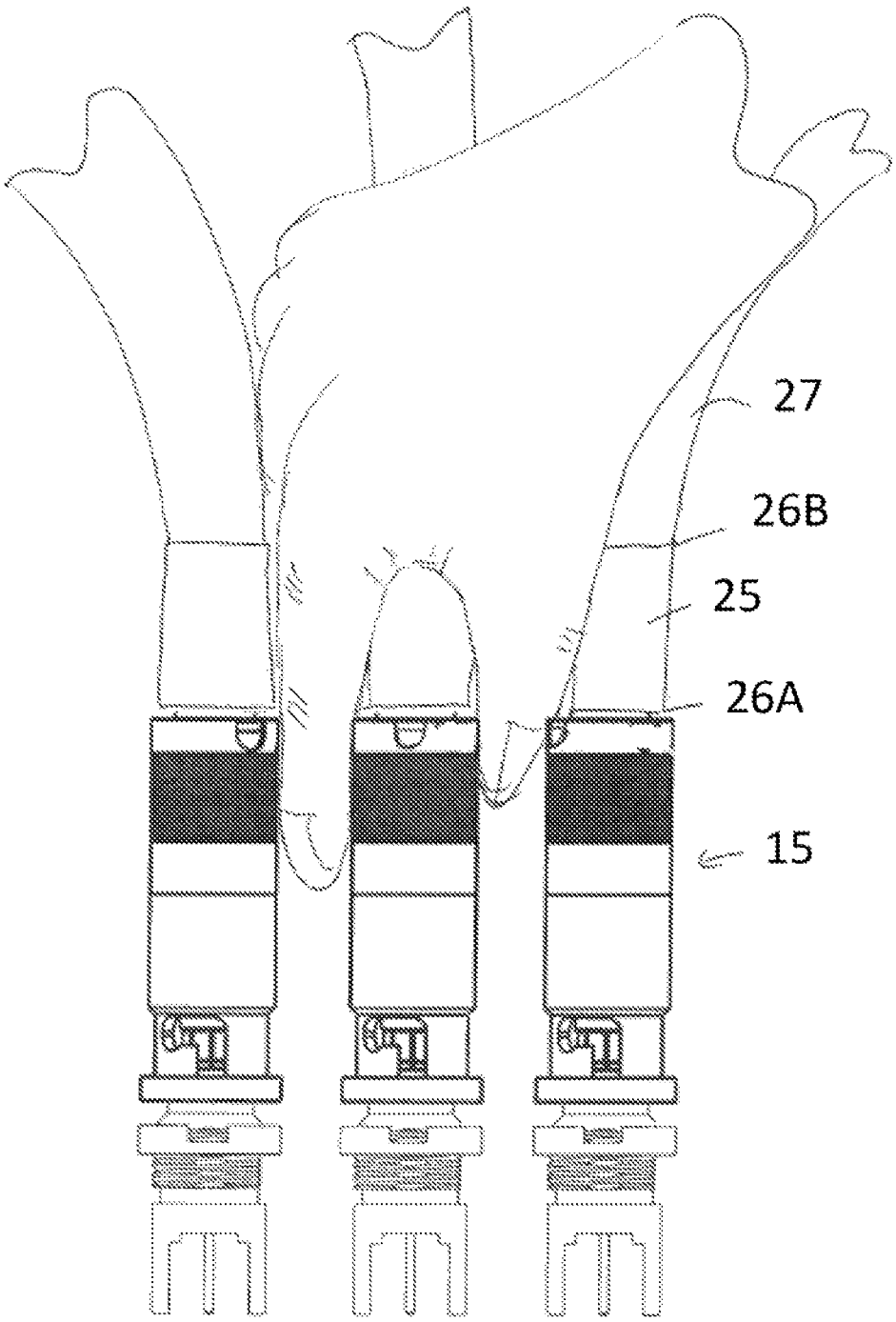
FIG. 4 illustrates the connection of a plug of the invention with a jack.

An electrical plug 15 embodying the present invention is shown in FIGS. 2 to 4. The plug 15 comprises a connector body having a first 17A and second 17B axial end (covered from view in FIG. 2). The first axial end 17A is electrically connectable in use to a jack 1, in a conventional manner. A central electrical contact (pin) is provided at the first axial end 17A for engagement with a corresponding electrical contact in the socket 3 of the jack 1. A ferrule 18 extends from the second axial end 17B of the connector body 16.

A sleeve 19 is rotatably mounted on the connector body 16 and has a first axial end 20A and a second axial end 20B. The first axial end 20A is provided with a pair of bayonet slots 21 for engagement, in use, with a respective lug 4 of a jack 1. The second axial end 20B of the sleeve 19 terminates at the second axial end 17B of the connector body 16. The result of this is that the sleeve 19 substantially encloses the connector body 16. The second axial end 20B of the sleeve 19 is substantially axially aligned with the second axial end 17B of the connector body 16. The first axial end 21A of the ferrule 18 is likewise aligned with the second axial end 20B of the sleeve 19 and the second axial end 17B of the connector body 16. Conveniently, there is no axial space between the first axial end 21A of the ferrule 18 and the second axial end 20B of the sleeve 19.

Preferably, the axial length of the sleeve 19 is equal to or longer than the axial length of the connector body 16. Preferably, the axial length of the sleeve 19 is greater than 10 mm. In one embodiment, the axial length of the sleeve 19 is greater than 15 mm. Advantageously, the axial length of the sleeve 19 is 21 mm. The axial length of the ferrule 18 is 9 mm. Preferably, the diameter of the sleeve 19 is 7 mm. Preferably, the ratio of the axial length of the sleeve 19 to the diameter is over 1, advantageously over 2. In the embodiment illustrated, the axial length of the sleeve 19 is 3 times greater than the diameter of the sleeve 19. Preferably, the outer diameter of the sleeve 19 is substantially constant along a portion extending at least 75% of the axial length of the sleeve 19 from the second axial end 20B of the sleeve 19.

As illustrated, the sleeve 19 further comprises a knurled section 22 proximate the second axial end 20B of the sleeve 19, distal from the first axial end 20A of the sleeve 19. Preferably, the knurled section 22 is around 5 mm in axial length. Advantageously, the knurled section 22 is at least 10 mm from the first axial end 20A of the sleeve 19.

In the embodiment shown, there is a gap 20B between the knurled section 22 and the second axial end 20B of the sleeve 19. Preferably, the gap 23 is 2 mm in axial length.

A location slot 24 is provided in the second axial end 20B of the sleeve 19, extending substantially across the gap 23 between the second axial end 20B of the sleeve 19 and the knurled section 22. During manufacture, the location slot 24 is randomly circumferentially located at the second axial end 20B of the sleeve 19. This random positioning is illustrated in FIG. 4. A corresponding lug on an insertion tool is operable to engage with the location slot 24 to assist in rotating the sleeve 19 during connection and removal of the plug 15 and jack 1.

A particular benefit of randomly positioning the location slot 24 is that it urges a user to manually verify that each of a plurality of connectors 5 is correctly mated with a respective jack 1, preferably using the insertion tool.

If the location slots 24 were in the same circumferential position relative to the bayonet slots 21, a user may otherwise assume that a connector 5 is correctly mated with a jack 1 because its location slot 24 appears to the installer to be in the same or similar orientation as those of neighbouring connectors 5. However, it could be that the connector 5 has not mated with the jack 1 at all. The positioning of the location slot in the same circumferential position relative to the bayonet slots can therefore cause false positives.

A particular benefit of providing the location slot 24 at the second axial end 20B of the sleeve 19 is that it is easily visible to a user looking substantially along the cable 27 towards the second axial end 20B of the sleeve 19. This assists the user in mating the insertion tool with the location slot 24. If the sleeve 19 did not extend substantially to the same axial point at the body, the location slot 24 would not be so easily visible/accessible.

Preferably, the inner diameter of the sleeve 19 is configured so as to be greater than the outer diameter of the crimping cover 25. Conveniently, the first axial end 26A of the crimping cover 25 substantially abuts with the axial face of the axial end 17B of the connector body 16, such that there is substantially no axial gap therebetween. This allows consistent positioning of the crimping cover 25 during assembly, as the user simply pushes the crimping cover 25 on until it abuts the end face of the second axial end 17B of the connector body 16.

The outer diameter of the connector body 16 may be equal to or greater than the outer diameter of the crimping cover 25.

A benefit of this arrangement is that the distance between the second axial end 20B of the sleeve 19 and the second axial end 26B of the crimping cover 25 are minimised to the greatest extent.

Preferably, the outer diameter of the sleeve 19 is larger than the inner diameter of the crimping cover 25, to prevent the crimping cover 25 sliding beyond the second axial end 20B of the sleeve 19 during assembly.

In the above embodiment, the crimping cover 25 is the radially outermost item secured to the terminal point of the cable 27. In other embodiments, there may be a plastic cover provided around the terminal point of the cable 27, either directly around the cable 27 or around a crimping cover 25. Whichever is the radially outermost item on the terminal point of the cable 27, it will be appreciated that the outer diameter of that item should be less than the inner diameter of the sleeve 19, to provide the same benefits as described above.

A benefit of these arrangements is that substantially all of the axial end face of the sleeve 19 is visible when a crimping cover (and/or plastic or other cover) is in place. Consequently, this further ensures that the location slot 24 is easily visible/accessible to the installer.

As illustrated in FIG. 4, a crimping cover 25 is further provided, having a first axial end 26A and a second axial end 26B. Preferably, the cover 25 is 13 mm in length. In use, the distance from the second axial end 20B of the sleeve 19 to the second axial end 26B of the crimping cover 25 is less than 20 mm, preferably 13 mm.

It should be noted that, in FIG. 4, the illustration of a user's hand is purely illustrative. No inferences should be made from the relative dimensions of the hand to those of the plug 15. The dimensions provided above in respect of certain embodiments of the plug 15 are definitive.

As illustrated in FIG. 4, embodiments of the present invention have significant benefits over known arrangements such as that shown in FIG. 1, as will now be described.

It will be appreciated that the connector body 16, 6 and sleeve 19, 8 are substantially rigid metal parts. When connected to a jack 1, substantially no movement of the plug 15 is allowed, such is the rigid mechanical connection between the plug and the jack. Likewise, when a metal crimping cover 25 is used, this too will be substantially rigid, by its secure attachment to the rigid ferrule 18 beneath. Only the cable 27 will offer any substantial flexibility.

To attach or remove a plug 15, the user must obtain and maintain purchase on the rotatable sleeve 19. Owing to their flexibility, the cables 27 of any neighbouring plugs 15 can be parted, to aid the access of a user's hand and/or fingers. The user's fingers need only to extend past the substantially rigid crimping cover 25 to obtain purchase on the knurled section of the sleeve 19. The benefit arises through minimising the distance between the second axial end 20B of the sleeve 19 and the flexible part of the cable 27 (adjacent second axial end 26B of the ferrule 18.

Figure 1:
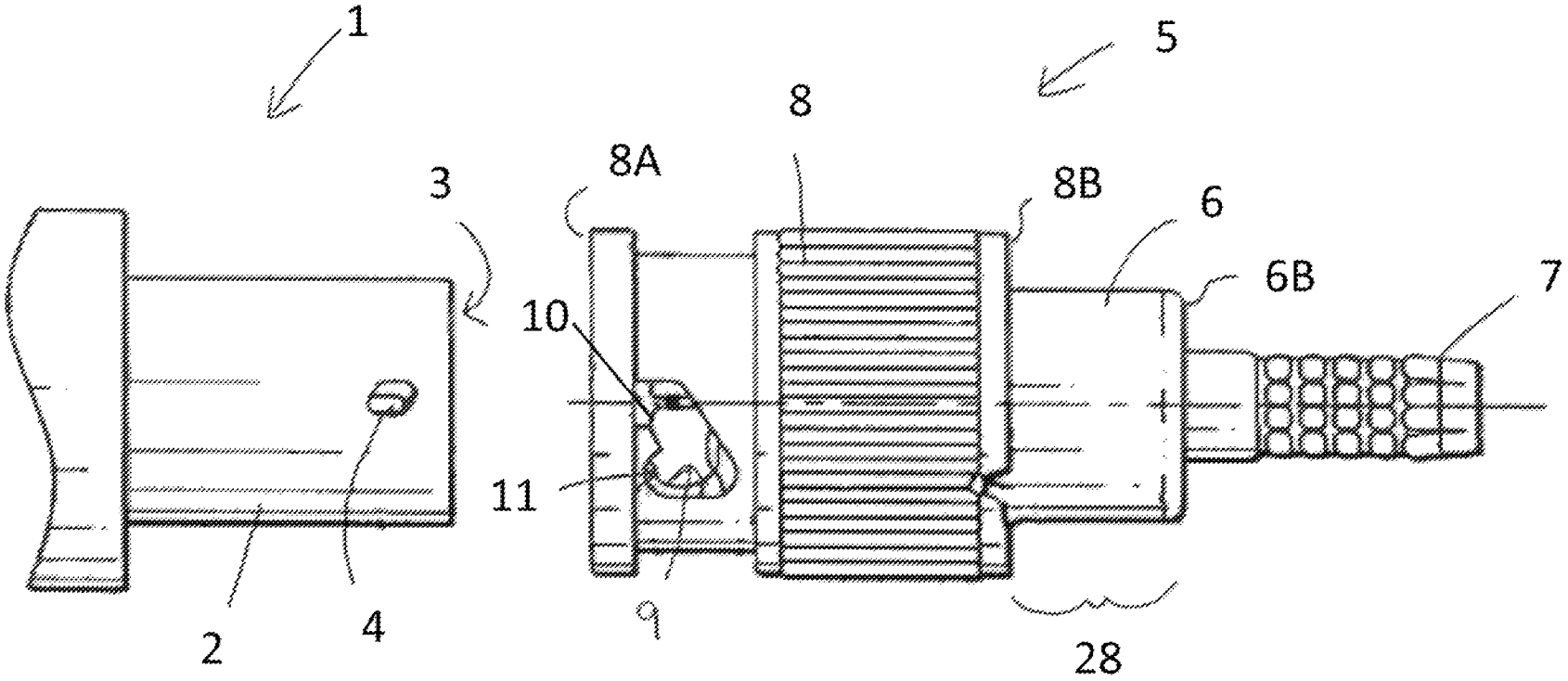
FIG. 1 (PRIOR ART)
FIG. 1 illustrates a known plug and jack.

By comparison, with reference to FIG. 1, the prior art plug 5 does not allow a user to readily obtain purchase on the sleeve 8. This is because a large part of the rigid connector body 6 lies between the second axial end 8B of the sleeve 8 and the beginning of the ferrule 7. The sleeve 8 only extends across around half the axial length of the connector body 6. The second axial end 8B of the sleeve 8 is axially spaced from the second end 6B of the connector body 6. The user's fingers must therefore reach further down between two plugs to obtain purchase on the sleeve. A user will likely not be able to obtain adequate purchase on the sleeve and/or risk injury to their fingers in attempting to do so.

A further problem with the prior art arrangement in FIG. 1 is that the axial length of the sleeve 8 is short. As a result, a user's fingers are likely to impact against the neighbouring jacks and//or the surface to which the jacks are mounted when installing/removing a plug. By comparison, the elongate sleeve of the invention allows a user to grip the sleeve at a point remote from the jack and/or surface to which the jacks are mounted.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. An electrical plug comprising:

a connector body having a first axial end and a second axial end, the first axial end electrically connectable in use to a jack;

a ferrule extending from the second axial end of the connector body, to which ferrule a cable is electrically and/or physically connectable in use; and an elongate sleeve rotatably mounted on the connector body and having a first axial end and a second axial end, wherein the first axial end of the elongate sleeve has at least one bayonet slot each for engagement, in use, with a respective lug of the jack, and the second axial end of the elongate sleeve terminates at the second axial end of the connector body, such that the elongate sleeve substantially encloses the connector body, wherein the second axial end of the elongate sleeve is provided with at least one location slot for engagement, in use, with an insertion tool.

2. An electrical plug according to claim 1, wherein the elongate sleeve has an axial length, the connector body has an axial length, and the axial length of the elongate sleeve is equal to or longer than the axial length of the connector body.

3. An electrical plug according to claim 1, wherein the elongate sleeve has an axial length and the axial length of the elongate sleeve is greater than 10 mm.

4. An electrical plug according to claim 3, wherein the axial length of the elongate sleeve is around 15 mm.

5. An electrical plug according to claim 1, wherein the elongate sleeve has an external surface and at least part of the external surface of the elongate sleeve is knurled.

6. An electrical plug according to claim 5, wherein the at least part of the external surface of the elongate sleeve that is knurled is proximate the second axial end of elongate sleeve.

7. An electrical plug according to claim 5, wherein the at least part of the external surface of the elongate sleeve that is knurled is distal from the first axial end of the elongate sleeve.

8. An electrical plug according to claim 5, wherein the at least part of the external surface of the elongate sleeve that is knurled is at least 10 mm from the first axial end of the elongate sleeve.

9. An electrical plug according to claim 1, wherein the elongate sleeve has an axial length and the axial length of the elongate sleeve is 20 mm.

10. An electrical plug according to claim 1, wherein the elongate sleeve has an external diameter and the external diameter of the elongate sleeve is 7 mm.

11. An electrical plug according to claim 1, wherein the second axial end of the elongate sleeve has a circumference and each of the at least one location slot is randomly located on the circumference of the second axial end of the elongate sleeve.

12. An electrical plug according to claim 1, further comprising a crimping sleeve having a first axial end and a second axial end, wherein the crimping sleeve is configured to physically and/or electrically connect a cable to the ferrule.

13. An electrical plug according to claim 12, comprising a cable physically and/or electrically connected to the ferrule with the crimping sleeve, wherein the first axial end of the crimping sleeve is adjacent the second axial end of the elongate sleeve and the cable extends from the second axial end of the crimping sleeve.

14. An electrical plug according to claim 13, wherein a distance from the second axial end of the elongate sleeve to the second axial end of the crimping sleeve is less than 20 mm.

15. A method of manufacture of an electrical plug configured for engagement with a jack connector, the method comprising:

providing a connector body having a first axial end and a second axial end, the first axial end electrically connectable in use to the jack connector;

providing a ferrule extending from the second axial end of the connector body, to which a cable is electrically and/or physically connectable in use; and rotatably mounting a sleeve on the connector body, the sleeve having a first axial end and a second axial end, wherein the first axial end of the sleeve has at least one bayonet slot each for engagement, in use, with a respective lug of the jack connector, and the second axial end of the sleeve terminates at the second axial end of the connector body, such that the sleeve substantially encloses the connector body, wherein the second axial end of the sleeve is provided with at least one location slot for engagement, in use, with an insertion tool.

16. A method according to claim 15, further comprising providing each of the at least one location slot at a different random circumferential position on the second axial end of the sleeve.

17. A mating pair of electrical connectors comprising:

a jack having a jack body with a lug radially extending from the jack body; and an electrical plug comprising:

a connector body having a first axial end and a second axial end, the first axial end electrically connectable in use to the jack;

a ferrule extending from the second axial end of the connector body, to which ferrule a cable is electrically and/or physically connectable in use; and an elongate sleeve rotatably mounted on the connector body and having a first axial end and a second axial end, wherein the first axial end of the elongate sleeve has a bayonet slot for engagement, in use, with the lug of the jack, and the second axial end of the elongate sleeve terminates at the second axial end of the connector body, such that the elongate sleeve substantially encloses the connector body, wherein the second axial end of the elongate sleeve is provided with a location slot for engagement, in use, with an insertion tool.

18. A mating pair of electrical connectors according to claim 17, wherein the elongate sleeve has an axial length, the connector body has an axial length, and the axial length of the elongate sleeve is equal to or longer than the axial length of the connector body.

19. A mating pair of electrical connectors according to claim 17, wherein the elongate sleeve has an axial length and the axial length of the elongate sleeve is greater than 10 mm.

20. A mating pair of electrical connectors according to claim 19, wherein the axial length of the elongate sleeve is around 15 mm.

21. A mating pair of electrical connectors according to claim 17, wherein the elongate sleeve has an external surface and at least part of the external surface of the elongate sleeve is knurled.

22. A mating pair of electrical connectors according to claim 21, wherein the at least part of the external surface of the elongate sleeve that is knurled is proximate the second axial end of elongate sleeve.

23. A mating pair of electrical connectors according to claim 21, wherein the at least part of the external surface of the elongate sleeve that is knurled is distal from the first axial end of the elongate sleeve.

24. A mating pair of electrical connectors according to claim 21, wherein the at least part of the external surface of the elongate sleeve that is knurled is at least 10 mm from the first axial end of the elongate sleeve.

25. A mating pair of electrical connectors according to claim 17, wherein the elongate sleeve has an axial length and the axial length of the elongate sleeve is 20 mm.

26. A mating pair of electrical connectors according to claim 17, wherein the elongate sleeve has an external diameter and the external diameter of the elongate sleeve is 7 mm.

27. A mating pair of electrical connectors according to claim 17, wherein the second axial end of the elongate sleeve has a circumference and the location slot is randomly located on the circumference of the second axial end of the elongate sleeve.

28. A mating pair of electrical connectors according to claim 17, further comprising a crimping sleeve having a first axial end and a second axial end, wherein the crimping sleeve is configured to physically and/or electrically connect a cable to the ferrule.

29. A mating pair of electrical connectors according to claim 28, comprising a cable physically and/or electrically connected to the ferrule with the crimping sleeve, wherein the first axial end of the crimping sleeve is adjacent the second axial end of the elongate sleeve and the cable extends from the second axial end of the crimping sleeve.

30. A mating pair of electrical connectors according to claim 29, wherein a distance from the second axial end of the elongate sleeve to the second axial end of the crimping sleeve is less than 20 mm.

* * * * *